US006913269B2

(12) United States Patent
Wang

(10) Patent No.: US 6,913,269 B2
(45) Date of Patent: Jul. 5, 2005

(54) UPGRADED STRUCTURE OF THE PEDESTAL OF ROLLER SHOES

(76) Inventor: Chih-Ping Wang, No. 88, Junlung Duon, Jungshing Rd., Lungtan Shiang, Taoyuan (TW)

( * ) Notice: Subject to any disclaimer, the term of this patent is extended or adjusted under 35 U.S.C. 154(b) by 105 days.

(21) Appl. No.: 10/419,209

(22) Filed: Apr. 21, 2003

(65) Prior Publication Data

US 2004/0207165 A1 Oct. 21, 2004

(51) Int. Cl.[7] ..... A63C 17/06
(52) U.S. Cl. ..... 280/11.225; 280/11.233
(58) Field of Search ..... 280/11.19, 11, 280/221, 11.225, 11.231, 11.233, 11.25, 11.27, 11.28; D21/764

(56) References Cited

U.S. PATENT DOCUMENTS 304,949 A * 9/1884 Mitchell ..... 280/11.19
4,202,511 A * 5/1980 Koslowski ..... 242/150 R
5,931,480 A * 8/1999 Schroeder ..... 280/11.28
6,354,608 B1 * 3/2002 Syrkos ..... 280/11.225
2002/0030332 A1 * 3/2002 Longino ..... 280/11.225

FOREIGN PATENT DOCUMENTS

| | | | |
|---|---|---|---|
| DE | 19522127 | * | 6/1995 |
| EP | 0559179 | * | 9/1993 |
| WO | WO 93/12846 | * | 7/1993 |
| WO | WO 93/12847 | * | 7/1993 |

* cited by examiner

*Primary Examiner*—Bryan Fischmann
(74) *Attorney, Agent, or Firm*—Rosenberg, Klein & Lee

(57) ABSTRACT

The improvement of the pedestal of roller shoes, which is a technique in the field of sports shoes, provides the capability of shock absorption. The improvement of the pedestal includes the following features: the middle part of the joint shelf is mounted to the pedestal, a roller is mounted to the one end; the middle part of the spring steel plate is mounted to the appropriate place of the pedestal, the two ends of it mount to the other ends of the two joint shelves. This new design will absorb the shock imposed on the rollers via the damping of the spring steel plate, and prevent the shock from going to the feet of the user.

1 Claim, 5 Drawing Sheets

UPGRADED STRUCTURE OF THE PEDESTAL OF ROLLER SHOES

FIELD OF THE INVENTION

The new design of an improved structure for the pedestal of roller shoes, which is technique in the field of sports shoes, provides an improved structure of the pedestal of roller shoes with the capability of shock absorption.

BACKGROUND OF THE INVENTION

Roller shoes such as roller skates and roller boots move on the ground through the rotation of the rollers, usually. Because the rollers are usually fixed to the pedestal of the shoes directly, when rolling on the ground, the roller will often be subjected to shock because of the irregularity of the ground; the shock is transmitted to the feet of the user through the rollers, directly and make the user feel uncomfortable. For long durations of activity using the roller shoes, the feet of the user may become tired and will be susceptible to injury.

SUMMARY OF THE INVENTION

This new design provides a structure of the pedestal of roller shoes with the capability of shock absorption. The shock experienced by the rollers will be prevented from going to the feet of the user, directly, through absorption of the shock via shock absorbers.

This new design will be carried out via the following techniques: the middle part of the joint shelf joints to the pedestal, a roller is mounted to the one end; the middle part of the spring steel plate is mounted to the appropriate place of the pedestal, the two ends of it are mounted to the other ends of the two joint shelves.

There is an axletree in the grooves on both sides of the above-mentioned rollers, the rollers joint to the holes at the ends of the joint shelf with the axletree; the joint shelf is mounted to the hole axis at the ends of the pedestal through the holes at the middle part (of the shelves), the middle part of the spring steel plate fixes to the pedestal; there is a collar mounted to the hole at the other end of the joint shelf, and the outer cylindrical faces of the collar are joined to the face of the end of the spring steel plate.

This new design will absorb the shock experienced by the rollers via the damping of the spring steel plate, and prevent the shock from going to the feet of the user through the pedestal directly; thus improving the comfort of the user and relieving the user of fatigue.

DETAILED DESCRIPTION OF THE PREFERRED EMBODIMENTS

Figure 1:
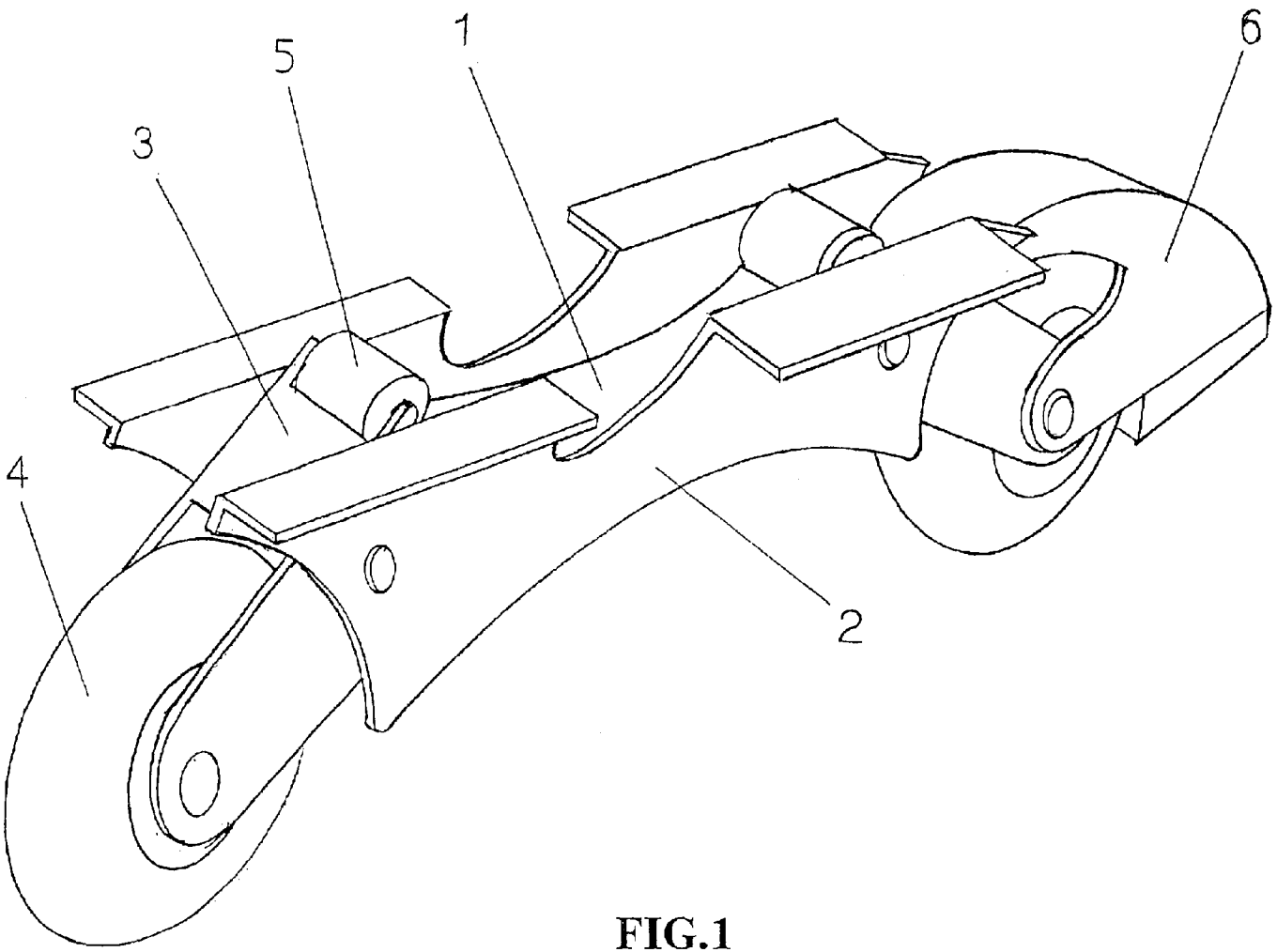
FIG. 1 is the 3-D blueprint of this new design.
Figure 2:
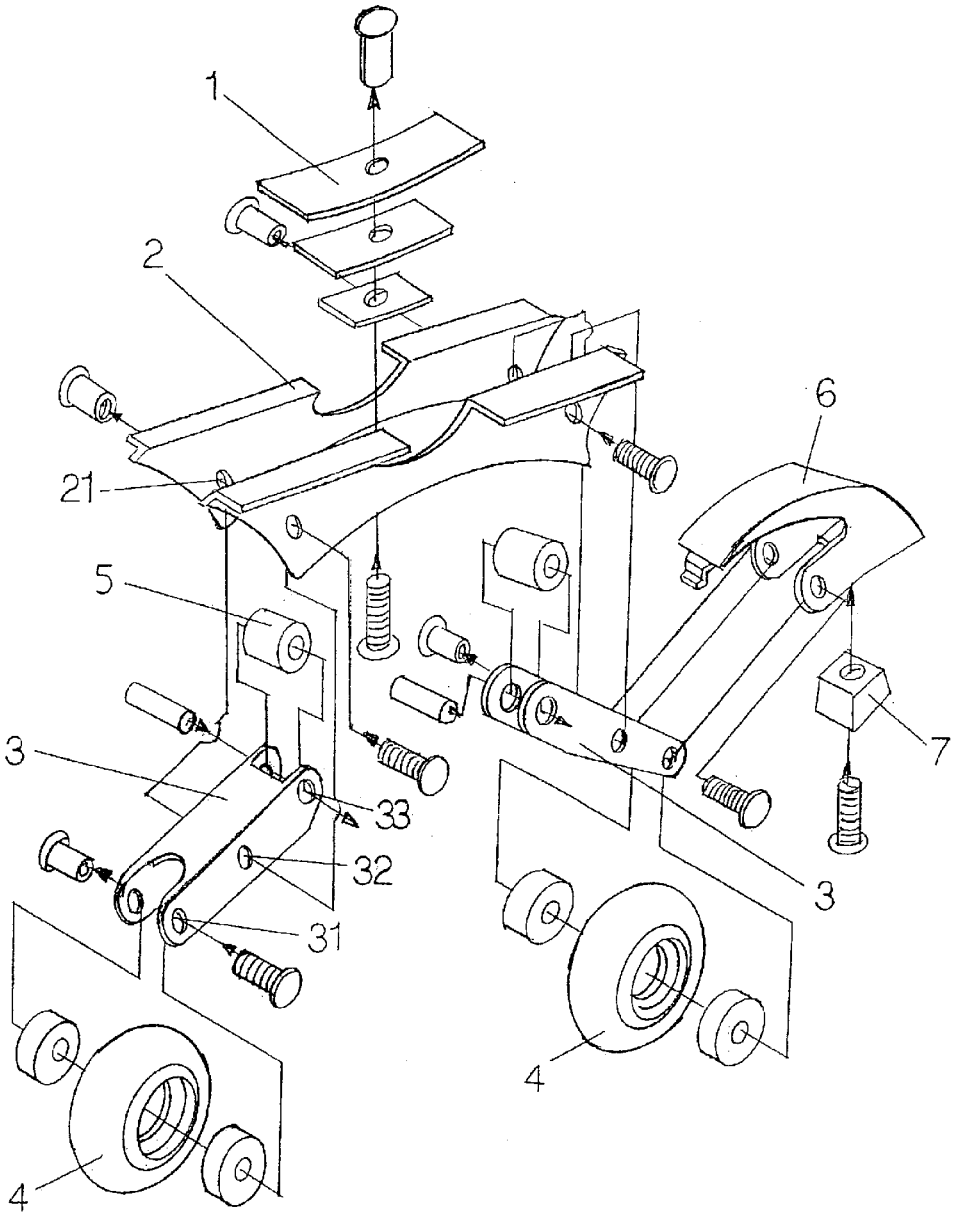
FIG. 2 is the 3-D disassemble blueprint of this new design.
Figure 3:
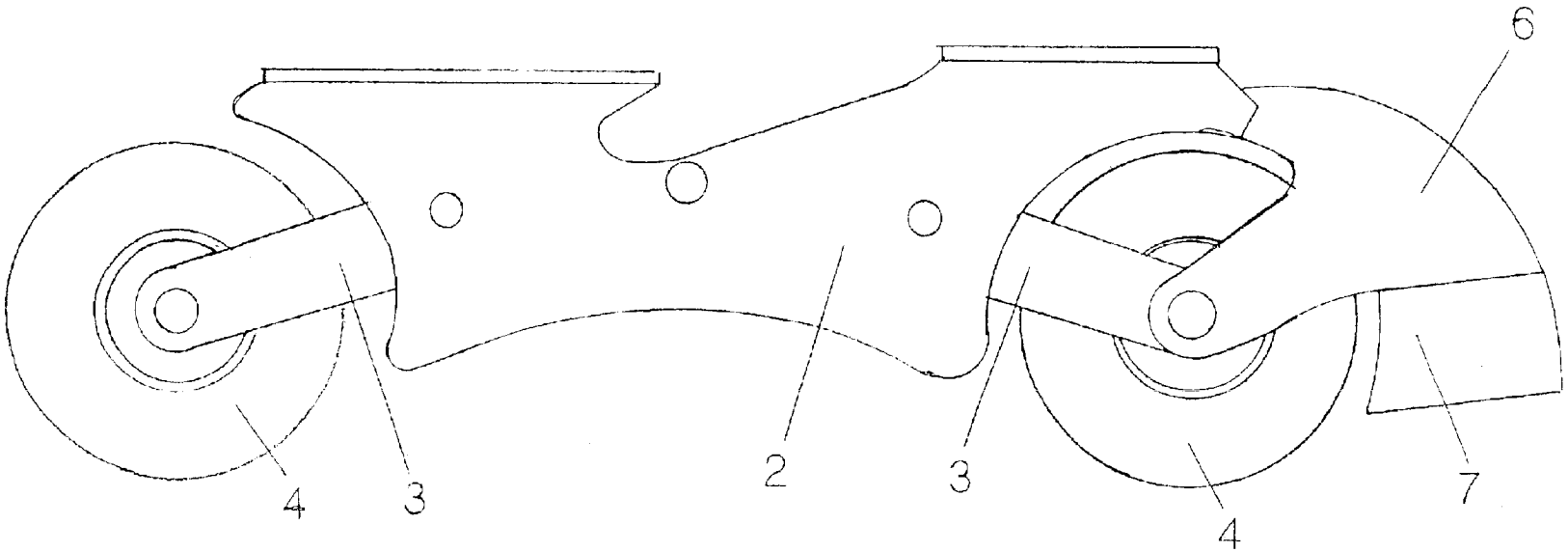
FIG. 3 is the direct view blueprint of this new design.
Figure 4:
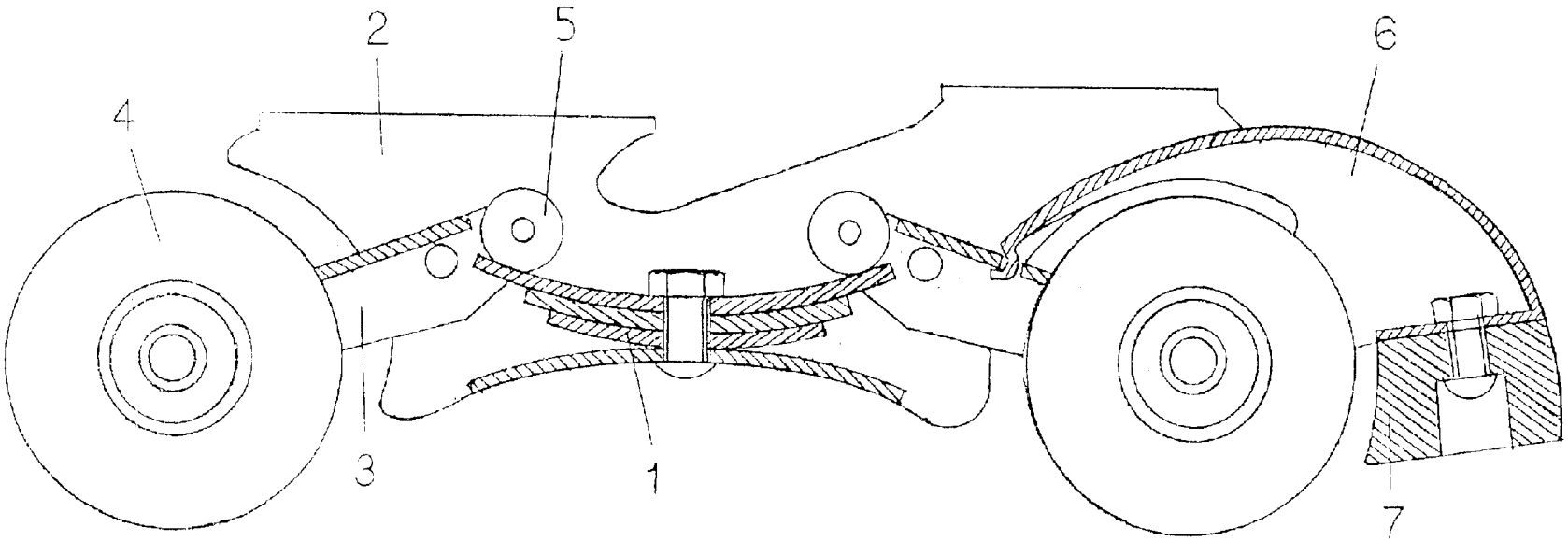
FIG. 4 is the cutaway view blueprint of this new design.
Figure 5:
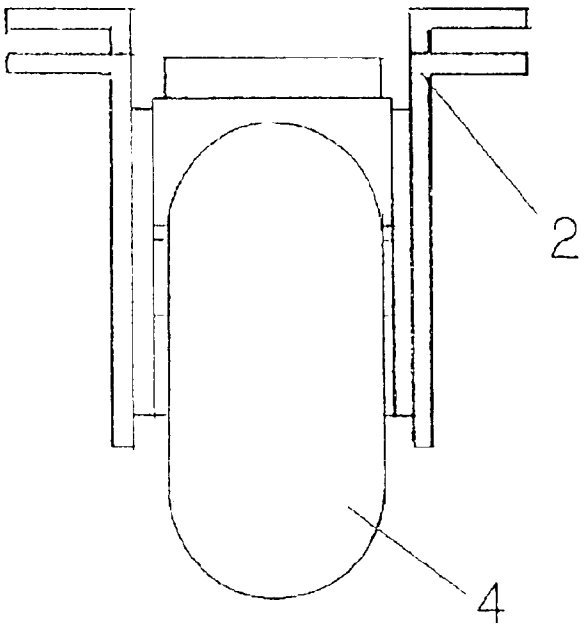
FIG. 5 is the side view blueprint of this new design.

Please refer to FIG. 1–5, the parts of this new design include spring steel plate 1, pedestal 2, joint shelf 3, roller 4, collar 5 etc. There is an axletree in the grooves on both sides of the roller 4, the rollers joint to the hole 31, at the ends of the joint shelf 3 with the axletree; the joint shelf 3 is mounted to the hole 21 axis at the end of the pedestal 2 through the hole 32 at the middle part (of the shelf); the middle part of the spring steel plate 1 fixes to the pedestal 2; there is a collar 5 mounted to the hole 33 at the other end of the joint shelf 3, and the outer cylindrical faces of the collar 5 are joined to the faces of the end of the spring steel plate 1.

When using this new design, the roller 4 contacts the ground, and is supported by the axletree in the grooves on the both sides of the roller to roll and move. To stop, the rubber brake 7 is fixed in brake shelf 6 to touch the ground. The collar 5 will force the spring steel plate 1 to absorb the shock. The shock will be absorbed via the damping of the spring steel plate 1, and it will prevent the shock from going to the feet of the user through the pedestal 2, and reduce the shock felt by the user.

What is claimed is:

1. An improvement of a pedestal of roller shoes, comprising:

a plurality of joint shelves, each of said joint shelves being mounted to said pedestal in a middle section thereof;

a plurality of wheels, each of said wheels being mounted to a first end of said plurality of joint shelves;

a spring steel plate, which is mounted to a corresponding section of said pedestal in the middle section thereof, and both ends of said spring steel plate touch a second end of said plurality of joint shelves; and, a plurality of shaft collars, each of said plurality of shaft collars being received by a hole formed through the second end of a corresponding one of said joint shelves and contacting said end of said spring steel plate.

* * * * *